United States Patent [19]

Hackney

[11] 3,998,368

[45] Dec. 21, 1976

[54] TENSION CONTROL FOR CONTINUOUS LENGTHS OF TEXTILE MATERIAL

[75] Inventor: Robert F. Hackney, Dalton, Ga.

[73] Assignee: West Point-Pepperell, Inc., Dalton, Ga.

[22] Filed: Dec. 11, 1975

[21] Appl. No.: 639,775

Related U.S. Application Data

[63] Continuation-in-part of Ser. No. 538,389, Jan. 3, 1975, abandoned.

[52] U.S. Cl. ..... 226/42; 226/44; 226/117

[51] Int. Cl.[2] ..... B65H 25/04

[58] Field of Search ..... 226/44, 42, 117, 118, 226/119

[56] References Cited

UNITED STATES PATENTS 1,673,521 6/1928 Maas ..... 226/44 X 2,727,378 12/1955 Cook ..... 226/44 X

*Primary Examiner*—Richard A. Schacher

*Attorney, Agent, or Firm*—Davis, Hoxie, Faithfull & Hapgood

[57] ABSTRACT

Apparatus for leading long lengths of woven or nonwoven textile material over a series of rolls in a sinous path in which the rolls are arranged in upper and lower tiers and some of the upper rolls are driven from electric motors. The lower tier of rolls is supported by parallel beams which are pivoted at one end. At their other ends the beams are connected by a chain and sprocket connection to a motor-speed-control device which automatically adjusts the speed of certain rolls to maintain constant tension on the material along its path through the apparatus, when the material causes the bottom rolls to move up or down.

30 Claims, 3 Drawing Figures

TENSION CONTROL FOR CONTINUOUS LENGTHS OF TEXTILE MATERIAL

This application is a continuation-in-part of my application Ser. No. 538,389, filed Jan. 3, 1975, now abandoned.

This invention relates to a tension control device which is useful in connection with tufted carpet making apparatus, and more particularly, in steam chambers through which a continuous length or sheet of dyed backing material is led, to heat-set the dye in the material. The invention is not limited to such usage but may be applied to any apparatus wherein it is necessary to maintain even tension of a sheet while it is being drawn over rolls in a sinuous path through apparatus and to prevent skewing and to take up slack or to retard or adjust the movement of the sheet through the apparatus, as occasion requires.

PRIOR ART PROBLEMS

In tufted carpet making, a long length of sheet material through which the tufting yarn is to be needled is dyed and then subjected to heat treatment in a steam chamber by being drawn in a sinuous path over rolls in the chambers. One example of such sheet material now on the market is a du Pont Company product known as TYPAR weighing about 3½ ounces per yard. It is made of fine, spun, synthetic, plastic, filaments having the appearance of two non-woven layers laid crosswise upon one another and matted. The material is thin and tough and resistant to distortion when dry, if subjected to lengthwise or lateral stress or pulling, but when wet, the material tends to skew as it is drawn through the steam chamber. It is particularly difficult to handle in known apparatus. A skew of 18 inches is not unusual at the end of a length in the neighborhood of 120 yards of the material. In the prior art apparatus the material tended also at times to sag below the bottom rolls of the sinuous path into an area where it was in danger of being burned by incoming high temperature steam. On the other hand, if the tension on the sheet was increased too much anywhere along its path, uneven stretching, or skewing, would result which would have to be corrected after the sheet issued from the apparatus. Such correction was expensive and time-consuming. The same difficulty exists to varying extents with woven backing sheets made of jute or synthetic materials, such as nylon or polypropylene.

Heretofore, efforts were made to maintain an even tension on the moving sheet by manual adjustment of a rheostat which would control the speed of the roll-driving motors. These efforts were unsatisfactory and required constant attention by an attendant.

SUMMARY OF THE INVENTION

It is an object of this invention to provide means to maintain an even tension of a web or sheet of material in apparatus in which the sheet is fed continuously along a sinuous path over a series of rolls, one or more of which is driven.

Another object is to provide in apparatus as aforesaid, for automatic adjustment of the speed of rotation of the driven rolls so as to compensate promptly for changes in the tension on the sheet passing through the apparatus.

Another object is to provide means as aforesaid, whose structure and operation are simple, and which can withstand the elevated temperatures of the apparatus, and which can be maintained in operating condition with a minimum of care and attention.

Other objects and advantages will become apparent as the invention is described in connection with the accompanying drawings.

According to the invention, two sets of spaced rolls are provided, the rolls of each set being spaced from each other, and the rolls of one set being bodily movable to shorten or lengthen the path of the sheet as it passes around them. The movement of the movable set is automatic in response to changes in tension on the sheet, and it automatically operates a control device, such as a rheostat, to vary the speed of the roll-driving electric motor which thereby tends to maintain an even tension on the sheet material.

Figure 1:
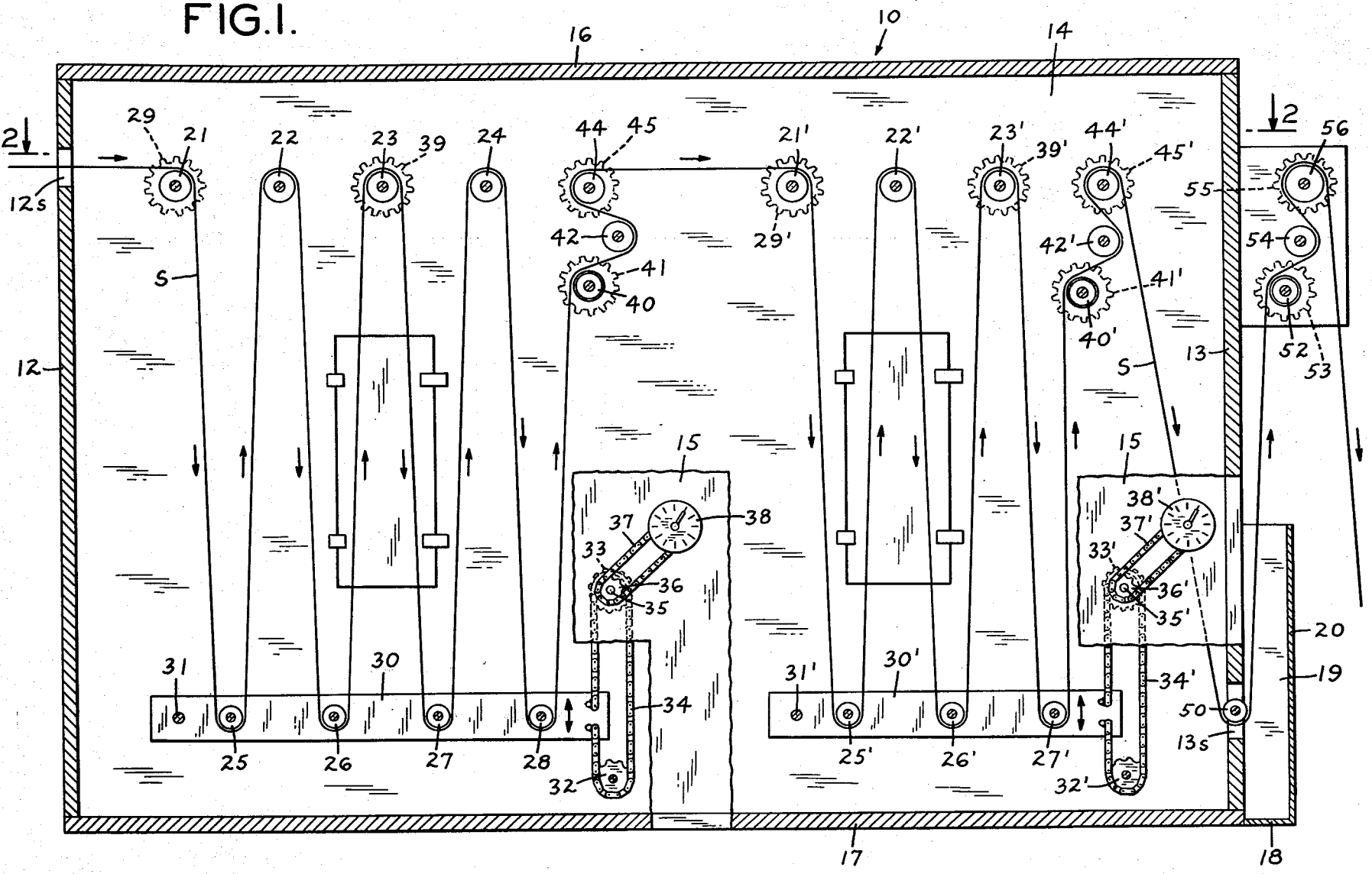
FIG. 1 is a side elevation view diagrammatically illustrating an apparatus embodying the invention. The side plate is removed in order to view the interior of the apparatus.

Referring to the drawings the invention, in the embodiment illustrated, is embodied in apparatus contained in a housing which, as illustrated, is generally rectangular, being formed of plain parallel end walls 12 and 13 and plain parallel side walls 14 and 15 and top and bottom walls 16 and 17. However, the invention is not limited to any particular shape of housing. Near the top of end wall 12 is a horizontal slot 12*s* through which a sheet of material S may enter into the housing. Another similar horizontal slot 13*s* may be provided near the bottom of the opposite end wall 13 for exit of the sheet material.

The entering sheet of material is trained over a series of horizontal spaced upper and lower parallel horizontal rolls 21 to 28, inclusive, which preferably are hollow stainless steel tubes mounted on shafts passing coaxially therethrough.

As illustrated, all the rolls that are within and outside the housing may be mounted in conventional fashion on suitable framework. For simplification of illustration and easier understanding the framework is omitted and the rolls inside the housing are illustrated as supported in or from the housing walls. In the particular embodiment illustrated, four upper rolls 21 to 24 constitute one group or upper tier and are located in horizontally spaced positions in the top part of the housing. They are rotatably supported in bearings in framework or in the side walls 14 and 15 or in any other suitable fashion. Four lower rolls 25 to 28, inclusive, constitute a second group or lower tier and are located in horizontally spaced positions. They are rotatably supported at their ends in bearings mounted in a pair of parallel beams of 30, one beam being located adjacent the side wall 14 and the other adjacent the side wall 15 near the bottom of the housing. The beam 30 may each be pivotally mounted at one end coaxially on coaxial stub shafts 31 mounted adjacent or in the side walls 14 and 15; or the beams may be mounted on the ends of a shaft extending across the housing between the side walls 14 and 15.

The sheet S is trained over the first top roll 21 and under the first bottom roll 25 and successively over and under rolls 22 and 26, 23 and 27, 24 and 28.

The first top roll 21 is preferably driven by a gear 29 on one outwardly extended end of its shaft from a motor through suitable conventional reduction gearing (not shown). Top rolls 22 and 24 may be idlers or float rolls. The intermediate roll 23 of the first group is preferably driven by a separate motor and reduction gearing through a gear 39 keyed on the outwardly extended end of the shaft of roll 23. Bottom rolls 25 to 28 preferably are idler rolls.

From the bottom roll 28 the sheet is trained around a third group of three horizontal rolls 40, 42 and 44 extending between the side walls 14 and 15 near the top of the housing. Top roll 44 of this group is spaced above roll 40; and roll 42 is offset from rolls 40 and 44 towards the exit end of the apparatus. The offsetting of roll 42 ensures contact of the sheet with a substantial portion of the periphery of the rolls 40 and 44.

The rolls of the third group may be rotatably supported at their ends in bearings in a frame or in the side walls 14 and 15 or in any other suitable fashion. The rolls 40 and 44 are driven rolls having the ends of their shafts extending outside the housing, with gears 41 and 45 on at least one end of each. Both of the gears 41 and 45 may be driven by conventional reducton gearing (not shown) from a single motor separate from the motors which drive rolls 21 and 23.

In order to maintain the sheets spread out across the rolls, the surface of roll 40 is provided with ridges formed or applied on the periphery and extending spirally around the roll. The ridges may be solid or staninless steel mesh. The direction of the spirals at one end of the roll extends from the middle in one direction, such as clockwise, while at the other end the spiral extends in the opposite direction, namely, counterclockwise. Thus the spirals tend to maintain the sheet spread as it passes on through the machine and to spread the sheet out and to overcome any tendency to bunch toward the center or wrinkle or move laterally.

The roll 44 is a pull roll which acts with driven rolls 21 and 23 to pull the sheet through the machine from its entrance slot in the side wall 12.

In order to maintain even tension on the sheet as it moves through the machine and to avoid skewing of the sheet, the free ends of the beams 30, opposite the pivoted end and toward the exit end of the apparatus, are each movably supported in the same way by being attached to a chain element 34. The chain 34 passes around an idler sprocket 32 below the beam 30 near the bottom of the housing and around another sprocket 33 above the beam and over the lower sprocket 32. The chains 34 may be fastened to the beams 30 by being cut to provide two ends, each being fastened to the free end of the beam 30. Alternatively the element may be of conventional belt-like form but affixed at one point along its length to the beam 30.

Preferably the sprockets 33 on the opposite sides of the apparatus are mounted on and keyed to a fixedly located rotary shaft 35 extending across the apparatus so that the two will move in unison. If the sheet becomes shortened or slack or tends to skew, the beams 30 will tend to move up or down, respectively, causing the upper inner sprocket 33 to turn and to rotate the shaft 35 on which it is mounted. This motion is transmitted to a sprocket 36 fixedly mounted on an end of the shaft 35 which extends outside the housing and has a chain 37 trained around it and connected in any suitable way to a conventional adjustable rheostat 38, or equivalent device for controlling the speed of an electric motor. This motor is the one that drives the upper roll 44 and spreader roll 40, and the hereinafter mentioned roll 21'.

Thus as the beam is caused to move up or down in response to changes in tension or skewing of the moving sheet S, the shaft 35 will be caused to oscillate which, via the sprocket 36 and chain 37, actuates rheostat 38 to cause the speed of the driving motor to be increased or decreased automatically. Only one rheostat is used for controlling the speed of the motor which drives rolls 40, 41 of the assemblage thus far described.

In the exit half of the housing, a second assemblage is provided which may be a duplicate of the assemblage just described. However, in the practical form disclosed herein, the second assemblage has one less upper roll and one less lower roll. The second assemblage has first and second groups of upper and lower rolls 21'–23' and 25'–27' like rolls 21–23 and 25–27 and a third group of spread and pull rolls 40', 42', 44' exactly like the rolls 40, 42 and 44. In other words, there are no equivalents for rolls 24 and 28 in the second assemblage. Instead, the sheet goes directly from roll 27' to roll 40'.

Tension control mechanism, identified by numerals 32'–38' is identical to 32–38 of the first assemblage.

The number of rolls and assemblages will depend on the time that the material should take going through the apparatus and be subjected to treatment.

From the pull roll 44 the sheet is trained around the second series of rolls 21' to 27', inclusive, and eventually to the rolls 40', 42', 44'.

The same drive is preferably used for the pull roll 44 of the first assemblage and the entrance roll 21' of the second assemblage in order to maintain an even tension as the sheet goes from the first to the second assemblage. Hence rheostat 38 controls roll 21' automatically.

A separate drive is provided for the pull roll 23'.

The sheet is drawn out of the apparatus through the bottom slot 13*s* in end wall 13 around an idler roll 50 located in the slot and mounted in bearings supported by side walls 14 and 15 or in a frame or in any other suitable fashion.

From exit roll 50 the sheet is led to spreader roll 52 and take-off rolls 56, being led around an idler 54 in between the spreader roll 52 and take-off rolls 56. The spreader roll 52 is like the spreader rolls 40 and 40' and the take-off roll is similar to driven rolls 21, 21'. All three of the rolls 52, 54 and 56 may be supported by any suitable frame work outside the end wall 13 of the apparatus and driven by gears 53 and 55 from the same reduction gearing motor that drives rolls 40' and 44', gears 53 and 55 being keyed on the extended ends of the shafts of rolls 52 and 56. Since rheostat 38' controls the motor which drives rolls 40' and 44', it will also automatically control the speed of rolls 52 and 56.

From the foregoing it will be noted that five separate driving motors are used as follows:

1. For entrance roll 21
2. For intermediate roll 23
3. For spreader roll 40, pull roll 44 and entrance roll 21'
4. For roll 23'
5. For rolls 40', 44', 52 and 56.

Of these motors numbers 3 and 5 are automatically controlled by rheostats 38 and 38', respectively, by operation of the tension responsive control means herein-described. Motors 1, 2 and 4 are set at the same time the appratus is started up, to give the desired speed constantly while the apparatus is running. This speed is manually adjustable before start up or may be varied manually during running until a speed is selected for continuous operation.

The motors employed may be direct current adjustable speed motors of a sort readily available on the market together with necessary components for controlling the current and power for speed adjustment. The motors and speed control circuitry per se, do not form a part of this invention and need not be more specifically described.

To catch any dye dropping from the sheet as it leaves the slot 13*s*, a trough is provided at the exit end of the apparatus adjacent end wall 13. The trough may be constructed in any suitable way as, for example, with a bottom wall 18 and parallel walls 19 and an end wall 20 connected to the side and bottom walls and parallel to housing wall 13.

From the apparatus above described the material goes to rinsing and drying apparatus (not shown) as usual to remove excess dye and then to remove remaining liquid. When the apparatus is prepared for start-up and started, the rheostats 38, 38′ are adjusted to develop the desired initial speed and the rolls they control, and similar control devices (not shown) at the control panel or other suitable location are likewise set to develop the desired constant speed on the other driven rolls. Thereafter the movement of the beams 30, 31 will automatically increase or decrease the resistance in the motor circuitry and thereby adjust the speed of the motors which drive rolls 44 and 44′ and thus control the tension of the material as it passes along its path through the apparatus.

Although chain and sprocket drive means has been described as preferred for operating the rheostats 38, 38′, it will be understood that other flexible connections which maintain a connection without slippage can be employed; or rigid connecting bars pivotally connected with levers, wheels or discs affixed to the beams 30, 30′, shafts 35, 35′ and rheostats 38, 38′ may be used.

While the invention is particularly advantageous in processing the TYPAR material above described, it is also advantageously used in processing woven and nonwoven material made of polypropylene, or woven jute material.

Figure 2:
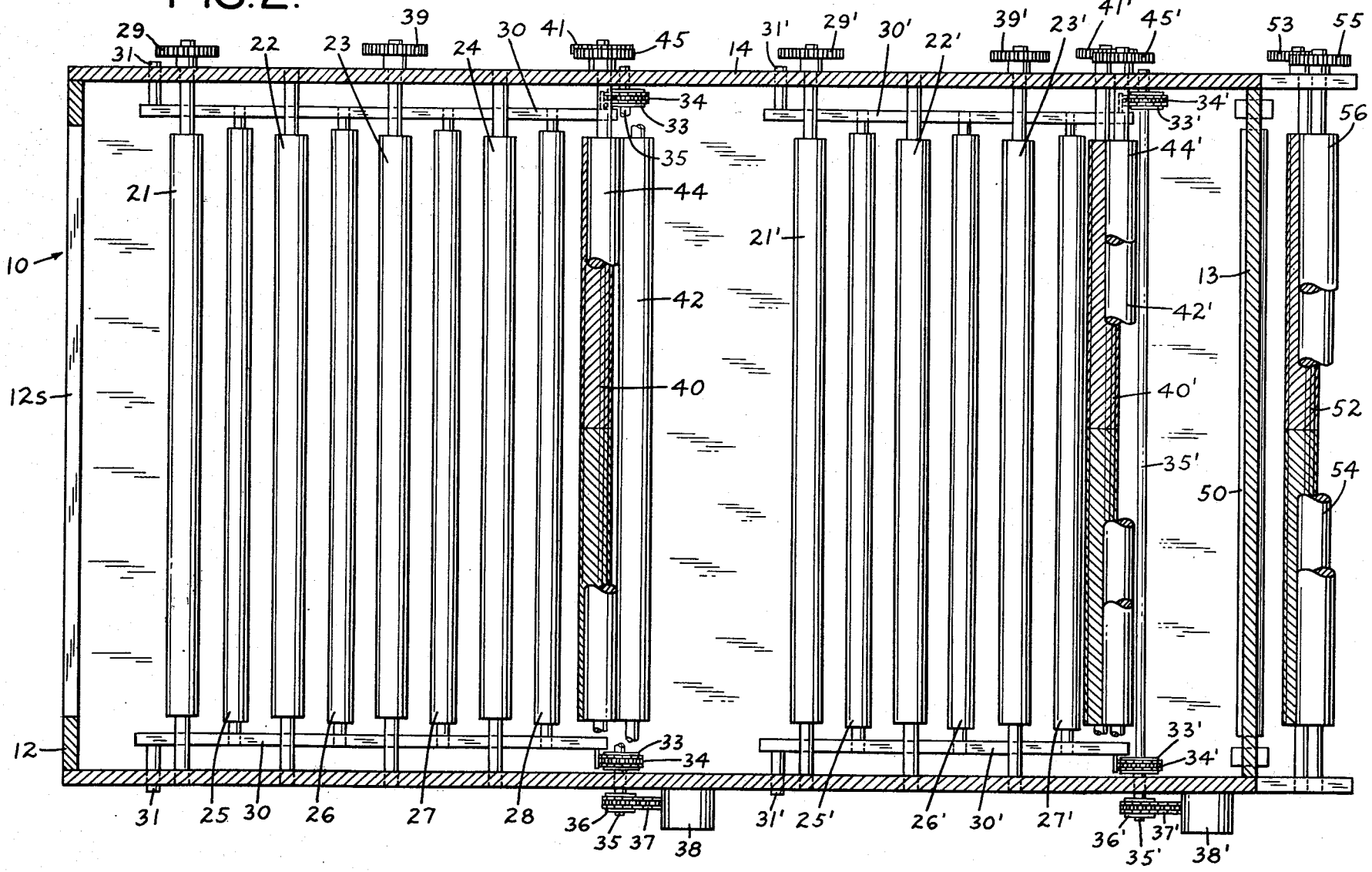
FIG. 2 is a plan view of the apparatus of FIG. 1, partly in section, taken along line 2—2 of FIG. 1.

In the foregoing embodiment illustrated in FIGS. 1 and 2, the adjustments of the speeds of the several motor drives at start-up and during operation would frequently or usually result in the peripheral speeds of the driven entrance roll and intermediate rolls 23 and 23′ being the same or approximately the same but subject to small manual adjustments being made of one or more, by the operator during machine operation.

Figure 3:
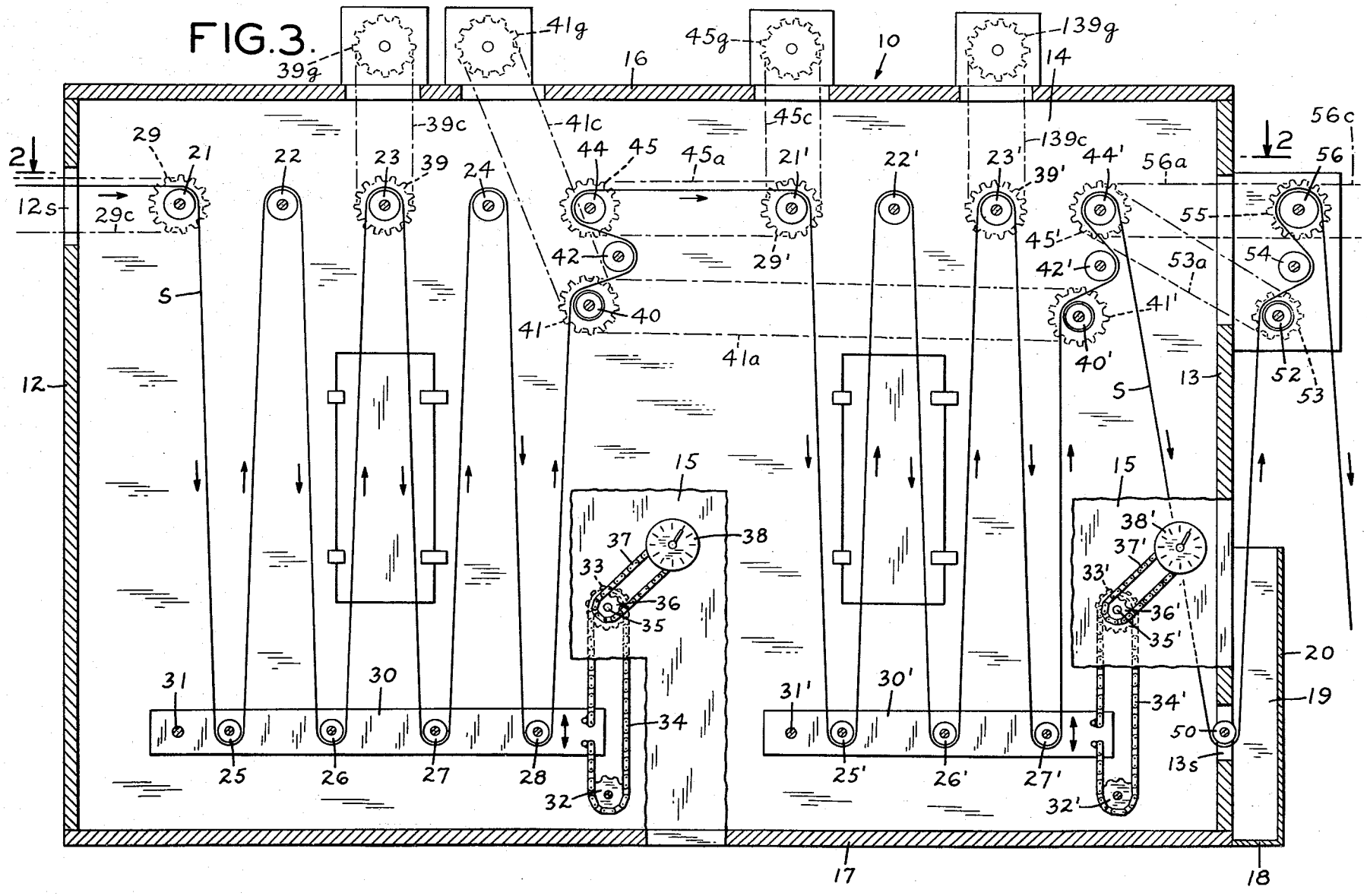
FIG. 3 is a view similar to FIG. 1 of another embodiment of the invention.

In another embodiment, as illustrated in FIG. 3, the drives of the various rolls are modified in a way which provides improved operation and smoother passage of the fabric through the apparatus. In this improved embodiment the driven rolls, the idler rolls and the spreader rolls may all be the same as in FIG. 1 and they all have the same reference numerals as in FIG. 1.

As before, the drive for entrance roll 21 is from a motor, which is the same as motor number 1 in the previous description, via reduction gearing and a chain here shown diagrammatically as 29*c* meshing with gear 29 on the shaft of roll 21.

Also as before, the drive for intermediate rolls 23 and 23′ is from motors, which are the same as motors numbers 2 and 4 in the previous description, via reduction gearing 39*g* and 139*g*, and chains here shown diagrmmatically as 39*c* and 139*c*, meshing with gears 39 and 39′ on the shafts of rolls 23, 23′, respectively.

In the FIG. 3 embodiment the spreader rolls 40, 40′ of the two assemblages are connected by a chain shown diagrammatically as 41*a*, so as to rotate in unison. They are driven by a chain 41*c*, shown diagrammatically, meshing with gear 41*g* of the reduction gearing from a fourth motor. Thus, in contrast to the previously described form, these spreader rolls in this embodiment are separately driven without connection to any other rolls. This enables these spreader rolls to have a different peripheral speed than the linear speed of the fabric for more effective spreading action. The spreader rolls can be driven in the same direction as the fabric travel but with a greater peripheral speed than the linear speed of the fabric or alternatively the spreader rolls may be driven in the opposite direction to the travel of the fabric, in which case the spreader rolls would be turned end for end so that the spiralling on the roll surface will be properly oriented to spread the fabric toward the ends of the rolls.

The spreader rolls may also be driven at a slower peripheral speed than the linear speed of the fabric or may remain stationary, the objective in each case being to provide a differential between the fabric speed and the peripheral speed of the rolls. When the spreader rolls are driven at the same speed or faster than the fabric and in the same direction, the spreader rolls aid the fabric movement, whilst under other conditions they retard such movement. Ability to separately drive the spreader rolls is advantageous because it enables changing their speed when different fabrics are being handled.

In FIG. 3, rolls 44′ and 56 are connected by chain 56*a* so that they rotate in unison, both being driven by a sixth motor and reduction gearing (not shown) via a chan 56*c*. This motor is also used to supply the driving power to spreader roll 52 via a chain 53*a* connecting the gear 53 on the shaft of roll 52 and a gear on the shaft of roll 44′. By proper selection of ratios of the gears, the spreader roll 52 can be driven at the same peripheral speed or faster or slower than the linear speed of the fabric, as desired, in accordance with the principles explained above in connection with spreader rolls 40 and 40′.

From the foregoing it will be observed that the invention provides apparatus for leading long lengths of fabrics through a chamber for steaming, drying or otherwise treating the fabric while travelling, which apparatus is particularly suited to maintaining the fabric spread and to keeping an even tension and to prevent skewing. The apparatus provides automatic adjustments of particular rolls which lead or pull the fabric through the apparatus, and also provides separate drives for the spreader rolls with ability to adjust their speed without affecting the speed of any other roll or the automatic control of the speed of certain of said other rolls.

In consequence of the adaptability of the machine and its capabilities for handling various kinds of fabrics, its usefulness as compared with prior art machines is greater, whilst at the same time the fabric is more effectively and more efficiently handled.

Many modifications of the invention will occur to those skilled in the art. Therefore, the invention is not limited to the specific embodiment illustrated and described.

I claim:

1. Apparatus for leading long lengths of woven or nonwoven textile material over a series of rolls in a sinous path comprising a series of parallel horizontal rolls arranged in upper and lower tiers, means mounting the rolls of the upper tier rotatably in spaced stationary positions, separate means at opposite ends of the lower tier supporting the rolls of the lower tier as a group in horizontally spaced positions, means pivotally mounting said separate supporting means at one end for movement separately when the tension of the passing material tends to vary, electric motor-driven means to rotate at least one of the upper tier of rolls, means to control the speed of said motor-driven means, means transmitting the motion of either of said separate supporting means to said control means for automatically controlling the speed of said driven means in response to variations in the tension of said material as it passes through the apparatus.

2. Apparatus as claimed in claim 1 which includes a fixedly mounted rotary spreader roll for spreading and maintaining the material out to full width as it passes.

3. Apparatus as claimed in claim 2 having means to drive said spreader roll by said motor-driven means.

4. Apparatus as claimed in claim 2 having means to drive said spreader roll separately from the other rolls.

5. Appatatus as claimed in claim 4 having means to cause the peripheral speed of the spreader roll to be different than the linear speed of the textile material.

6. Apparatus as claimed in claim 2 having means to cause the peripheral speed of the spreader roll to be different than the linear speed of the textile material.

7. Apparatus as claimed in claim 2 having means to mount said spreader roll for end-to-end reversal and means to cause the peripheral speed of the spreader roll to be different than the linear speed of the textile material including movement in the opposite direction to the movement of the material.

8. Apparatus as claimed in claim 1 in which said upper tier includes a second driven roll, located at the entering position of said material.

9. Apparatus as claimed in claim 8 which includes a fixedly mounted rotary spreader roll for spreading and maintaining the material out to full width as it passes.

10. Apparatus as claimed in claim 9 having means to drive said spreader roll separately from the other rolls.

11. Apparatus as claimed in claim 9 in combination with similar apparatus to which said material is fed from the first-mentioned driven roll, and means causing said first-mentioned driven roll of said first apparatus and the entrance driven roll of the second apparatus to be driven at the same peripheral speed by the same driving means, and means to drive said spreader rolls in unison separately from the other rolls.

12. Apparatus as claimed in claim 11 having means to cause the peripheral speed of the spreader rolls to be different than the linear speed of the textile material.

13. Apparatus as claimed in claim 11 in which the roll in the said similar apparatus equivalent to the said first-mentioned driven roll of the first apparatus is an exit roll, in combination with a take-off roll and an additional spreader roll, and means to drive said additional spreader roll and said take-off roll from the electric motor driven means for the exit roll of said similar apparatus.

14. Apparatus as claimed in claim 9 in which said spreader roll is positioned between the driven entrance roll and the other driven roll.

15. Apparatus as claimed in claim 14 having means to drive said spreader roll separately from the other rolls.

16. Apparatus as claimed in claim 14 in combination with similar apparatus to which said material is fed from the first-mentioned driven roll, and means causing said first-mentioned driven roll of said first apparatus and the entrance driven roll of the second apparatus to be driven at the same peripheral speed by the same driving means, and means to drive said spreader rolls in unison separately from the other rolls.

17. Apparatus as claimed in claim 14 having means to drive said spreader roll by the same motor-driven means as the said other driven roll.

18. Apparatus as claimed in claim 9 having means to drive said spreader roll by the same motor-driven means as said first-mentioned motor-driven means.

19. Apparatus as claimed in claim 8 in which said transmitting means includes chain and sprocket means.

20. Apparatus as claimed in claim 8 in combination with similar apparatus to which said material is fed from the first-mentioned driven roll, and means causing said first-mentioned driven roll of said first apparatus and the entrance driven roll of the second apparatus to be driven at the same peripheral speed by the same driving means.

21. Apparatus as claimed in claim 1 in which said transmitting means includes a non-slip flexible connection.

22. Apparatus as claimed in claim 1 in which said transmitting means includes chain and sprocket means.

23. Apparatus as claimed in claim 1 in which said transmitting means includes connecting means and an electrical device operable to increase and decrease the speed of an electric motor, said connecting means being connected to said device and to said lower-roll-supporting means.

24. Apparatus as claimed in claim 23 in which said connecting means includes a chain attached to said lower-roll-supporting means, and a sprocket engaged by said chain, and means connecting said sprocket to said electrical device for operating the latter.

25. Apparatus as claimed in claim 24 in which the connecting means last-claimed comprises a chain and sprocket connection.

26. Apparatus for leading long lengths of woven or nonwoven textile material over a series of rolls in a sinuous path comprising a series of parallel horizontal rolls arranged in upper and lower tiers, means mounting the rolls of the upper tier rotatably in spaced stationary positions, a pair of independent parallel beams supporting the rolls of the lower tier as a group at opposite ends in horizontally spaced positions, means separately mounting said beams at one end about fixed pivots for movement separately when the tension of the passing material tends to vary, electric motor-driven means to rotate at least one of the upper tier of rolls, separate chain and sprocket means connected to the free ends of said beams, a transverse shaft connecting said sprocket means for rotation thereof in unison, means operated by said shaft to control the speed of said elctric motor-driven means in response to variations in the tension of the material as it passes through the apparatus.

27. Apparatus as claimed in claim 26 in combination with similar apparatus to which said material is fed from the first-mentioned driven roll, and means causing said first-mentioned driven roll of said first apparatus and the entrance driven roll of the second apparatus to be driven at the same peripheral speed by the same driving means.

28. Apparatus as claimed in claim 26 in which said upper tier includes a second driven roll, located at the entering position of said material.

29. Apparatus as claimed in claim 28 which includes a fixedly mounted rotary spreader roll for spreading and maintaining the material out to full width as it passes.

30. Apparatus as claimed in claim 28 in combination with similar apparatus to which said material is fed from the first-mentioned driven roll, and means causing said first-mentioned driven roll of said first apparatus and the entrance driven roll of the second apparatus to be driven at the same peripheral speed by the same driving means.

* * * * *